US008789735B2

(12) United States Patent
Crawford et al.

(10) Patent No.: US 8,789,735 B2
(45) Date of Patent: Jul. 29, 2014

(54) FLOOR STAPLER SHOE

(76) Inventors: Scott David Crawford, Oxford, MI (US); Steve Alan Combs, White Lake, MI (US)

( * ) Notice: Subject to any disclaimer, the term of this patent is extended or adjusted under 35 U.S.C. 154(b) by 0 days.

(21) Appl. No.: 12/623,102

(22) Filed: Nov. 20, 2009

(65) Prior Publication Data

US 2010/0187282 A1 Jul. 29, 2010

Related U.S. Application Data

(60) Provisional application No. 61/116,790, filed on Nov. 21, 2008.

(51) Int. Cl.
*B25C 7/00* (2006.01)

(52) U.S. Cl.
USPC ..... 227/140

(58) Field of Classification Search
USPC ..... 227/148, 110, 111, 140
See application file for complete search history.

(56) References Cited

U.S. PATENT DOCUMENTS

| | | | | | |
|---|---|---|---|---|---|
| 1,693,290 | A * | 11/1928 | Fawcett | 227/111 |
| 2,169,433 | A * | 8/1939 | Roy | 227/110 |
| 2,457,984 | A * | 1/1949 | Dougherty | 227/111 |
| 3,012,247 | A * | 12/1961 | Sillars et al. | 227/121 |
| 3,360,176 | A * | 12/1967 | Gehl et al. | 227/148 |
| 3,417,877 | A * | 12/1968 | Corley | 414/11 |
| 3,619,895 | A * | 11/1971 | Thompson | 29/432 |
| 3,764,053 | A * | 10/1973 | Thompson | 227/111 |
| 3,972,462 | A * | 8/1976 | Evans et al. | 227/111 |
| 4,225,074 | A * | 9/1980 | Jacobson | 227/2 |
| 4,309,805 | A * | 1/1982 | Jacobson | 29/429 |
| 4,732,307 | A * | 3/1988 | Hubbard et al. | 227/7 |
| 5,042,142 | A * | 8/1991 | Beach et al. | 29/787 |
| 5,062,562 | A * | 11/1991 | Michael | 227/111 |
| 6,371,348 | B1 * | 4/2002 | Canlas et al. | 227/8 |
| 7,255,256 | B2 * | 8/2007 | McGee et al. | 227/8 |
| 7,565,992 | B2 * | 7/2009 | Buetow | 227/110 |
| 7,614,536 | B2 * | 11/2009 | Shtylman | 227/107 |
| 7,882,994 | B2 * | 2/2011 | Francescon | 227/148 |
| 7,886,950 | B2 * | 2/2011 | Lin et al. | 227/148 |
| 7,926,141 | B2 * | 4/2011 | Dayton et al. | 15/23 |
| 8,056,785 | B2 * | 11/2011 | Gosis et al. | 227/19 |
| 2006/0261129 | A1 * | 11/2006 | McGee et al. | 227/148 |
| 2007/0017953 | A1 * | 1/2007 | Hamar | 227/8 |
| 2007/0257081 | A1 * | 11/2007 | Dion et al. | 227/148 |
| 2010/0077562 | A1 * | 4/2010 | Block et al. | 16/46 |

* cited by examiner

*Primary Examiner* — Robert Long
(74) *Attorney, Agent, or Firm* — Reising Ethington PC

(57) ABSTRACT

A floor stapler shoe used in the installation of hardwood floors includes a shoe body and a pair or more antifriction components. The shoe body is designed to receive and connect with a floor stapler. One of the pair of antifriction components contacts a tongue of a floor board when in use, and the other of the pair of antifriction components contacts an upper surface of the floor board when in use. The antifriction components can be a bearing, a pad composed of antifriction material, or both.

11 Claims, 4 Drawing Sheets

FLOOR STAPLER SHOE

CROSS-REFERENCE TO RELATED APPLICATION

This application claims the benefit of U.S. Provisional Application No. 61/116,790 filed Nov. 21, 2008. The disclosure of the above application is incorporated herein by reference.

FIELD OF THE INVENTION

This invention relates to hardwood floor installation tools and more particularly to shoes used with floor stapler tools.

BACKGROUND OF THE INVENTION

Installing hardwood floors typically includes nailing rows of floor boards to an underlying subfloor. Floor staplers are commonly used to drive staples or nails through the floor boards and into the subfloor. The floor staplers are often equipped with shoes that sit against the floor boards and help aim the driven staples or nails. Typically, between each neighboring driven staple or nail, the floor stapler is lifted off of the floor board and re-seated against the floor board. Among other things, this can slow the hardwood floor installation process and can cause mispositioning staples or nails with respect to one another.

SUMMARY OF THE INVENTION

One embodiment of a floor stapler shoe includes a shoe body, one or more first antifriction components, and one or more second antifriction components. The shoe body is constructed to connect to a floor stapler. The one or more first antifriction components extend directly or indirectly from the shoe body and is/are located at a place where it/they contacts a tongue outer surface of a floor board. The one or more second antifriction components extend directly or indirectly from the shoe body and is/are located at a place where it/they contacts an upper surface of the floor board. In use, the antifriction components allow the floor stapler shoe to slide in the longitudinal direction along the floor board from a first stapling location to a second stapling location that is spaced away from the first stapling location. During the longitudinal sliding, the antifriction components can maintain contact with the floor board.

Another embodiment of a floor stapler shoe includes a shoe body, a first guide block, a second guide block, a first side block, and a second side block. The shoe body is constructed to receive a floor stapler. The shoe body has a lower wall that confronts a floor board through a space; the lower wall has an opening through which a staple ejected from the floor stapler can pass. The first guide block extends directly or indirectly from the shoe body and has a first antifriction component. The first antifriction component is located at a place where it contacts a tongue outer surface of the floor board. The second guide block extends directly or indirectly from the shoe body and has a second antifriction component. The second antifriction component is located at a place where it contacts the tongue outer surface of the floor board. The first side block extends directly or indirectly from the shoe body and has a third antifriction component. The third antifriction component is located at a place where it contacts an upper surface of the floor board. The second side block extends directly or indirectly from the shoe body and has a fourth antifriction component. The fourth antifriction component is located at a place where it contacts the upper surface of the floor board. The above-mentioned contact occurs during use of the floor stapler shoe.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
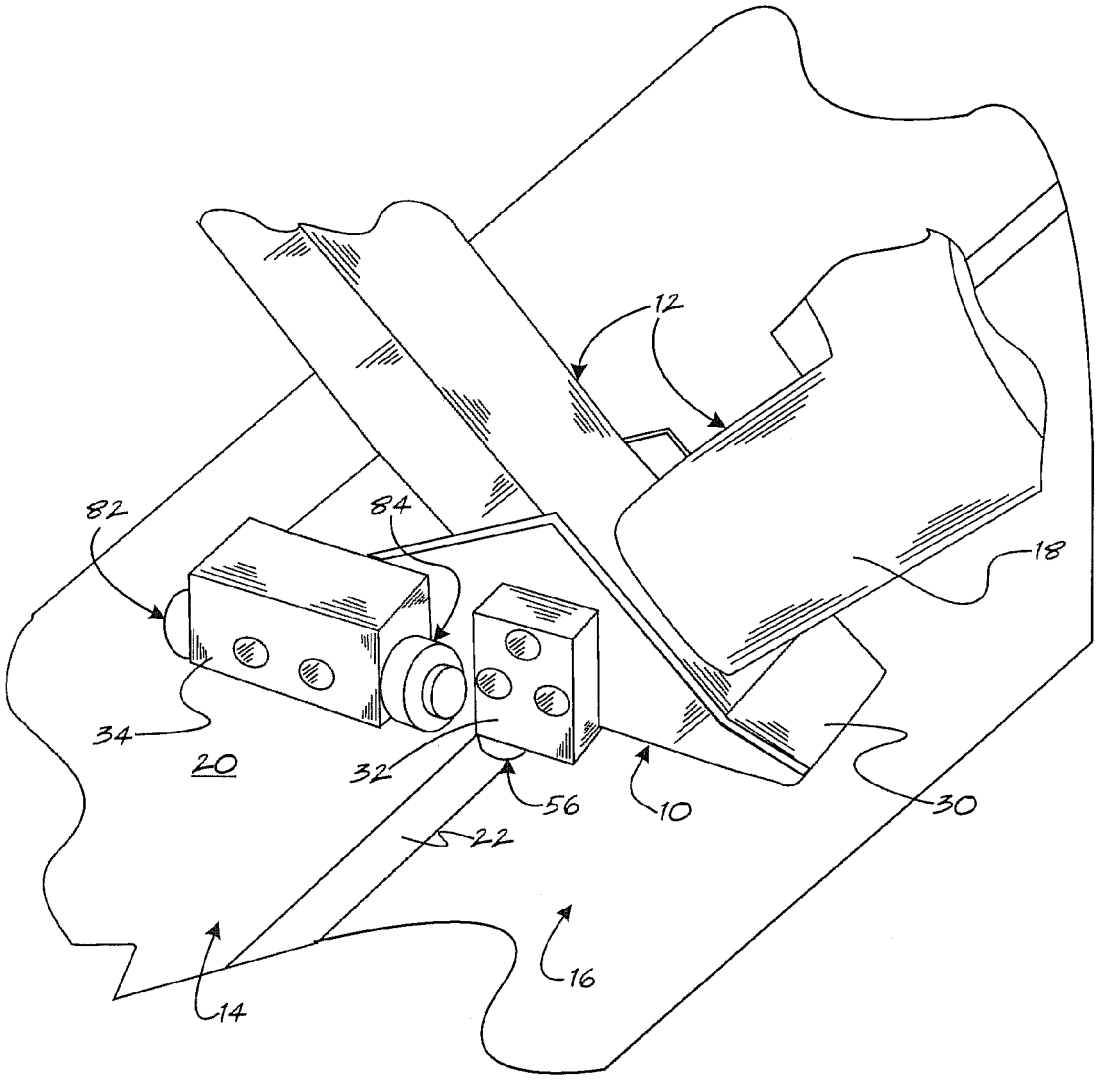
FIG. 1 is a perspective view of an exemplary embodiment of a shoe connected to a floor stapler.

Referring to the drawings, an exemplary embodiment of a shoe 10 is used with a floor stapler 12 to drive staples or nails through a floor board 14 and into an underlying subfloor 16. The shoe 10 is designed to slide longitudinally along the floor board 14 between neighboring stapling or nailing locations so that the floor stapler 12 need not be lifted off of the floor board and re-seated between the successive locations. This will speed-up the hardwood floor installation process and aid in providing proper and consistent staple or nail positioning.

The floor stapler 12—also called a floor nailer—forces staples or nails through the floor board 14 and into the subfloor 16. The floor stapler 12 can be pneumatically, hydraulically, or electrically actuated. Such staplers are well-known. For example, the floor stapler 12 can be a pneumatically actuated floor stapler such as the MIIIFS Flooring Stapler sold by Stanley-Bostich of East Greenwich, R.I., U.S.A. (www.bostich.com). Of course, any suitable stapler including those made by other floor stapler manufacturers may be used. Referring to FIG. 1, the floor stapler 12 preferably includes a barrel portion 18 which bases the mechanism used to drive the staple or nail when a rubber mallet strikes a plunger (not shown) of the floor stapler. The barrel portion 18 connects to the shoe 10 at its end.

Figure 3:
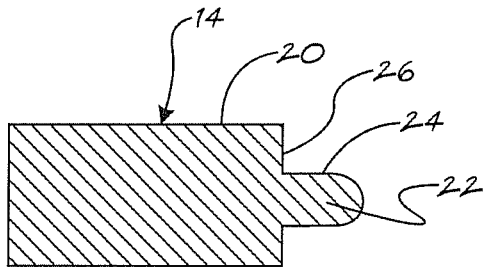
FIG. 3 is a sectioned view of an exemplary embodiment of a floor board.

Multiple floor boards 14 are assembled side-by-side to construct a hardwood floor. Neighboring floor boards 14 mate together via a tongue-and-groove connection. Referring to FIG. 3, each floor board 14 has an exposed upper surface 20 and a tongue 22 formed in an end thereof. The tongue 22 can have different shapes. In this example, the tongue 22 has an outer surface 24 with a substantially flat face 26.

Figure 2:
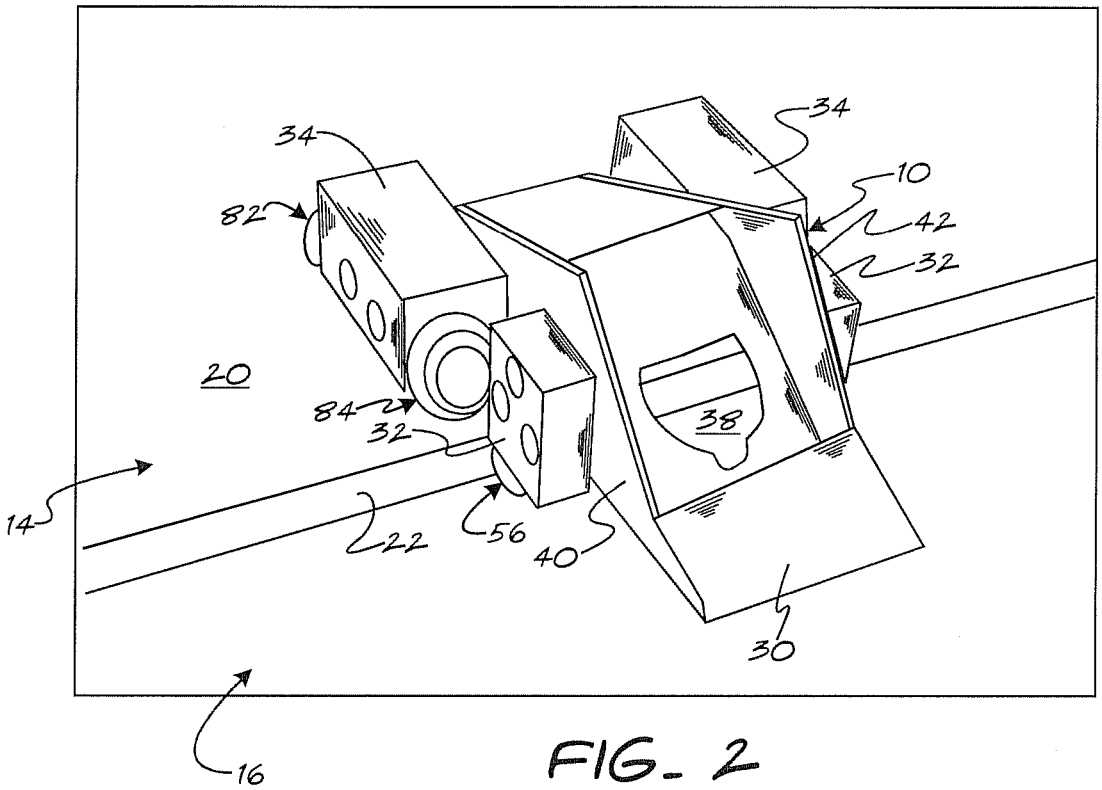
FIG. 2 is another perspective view of the shoe of FIG. 1.
Figure 4:
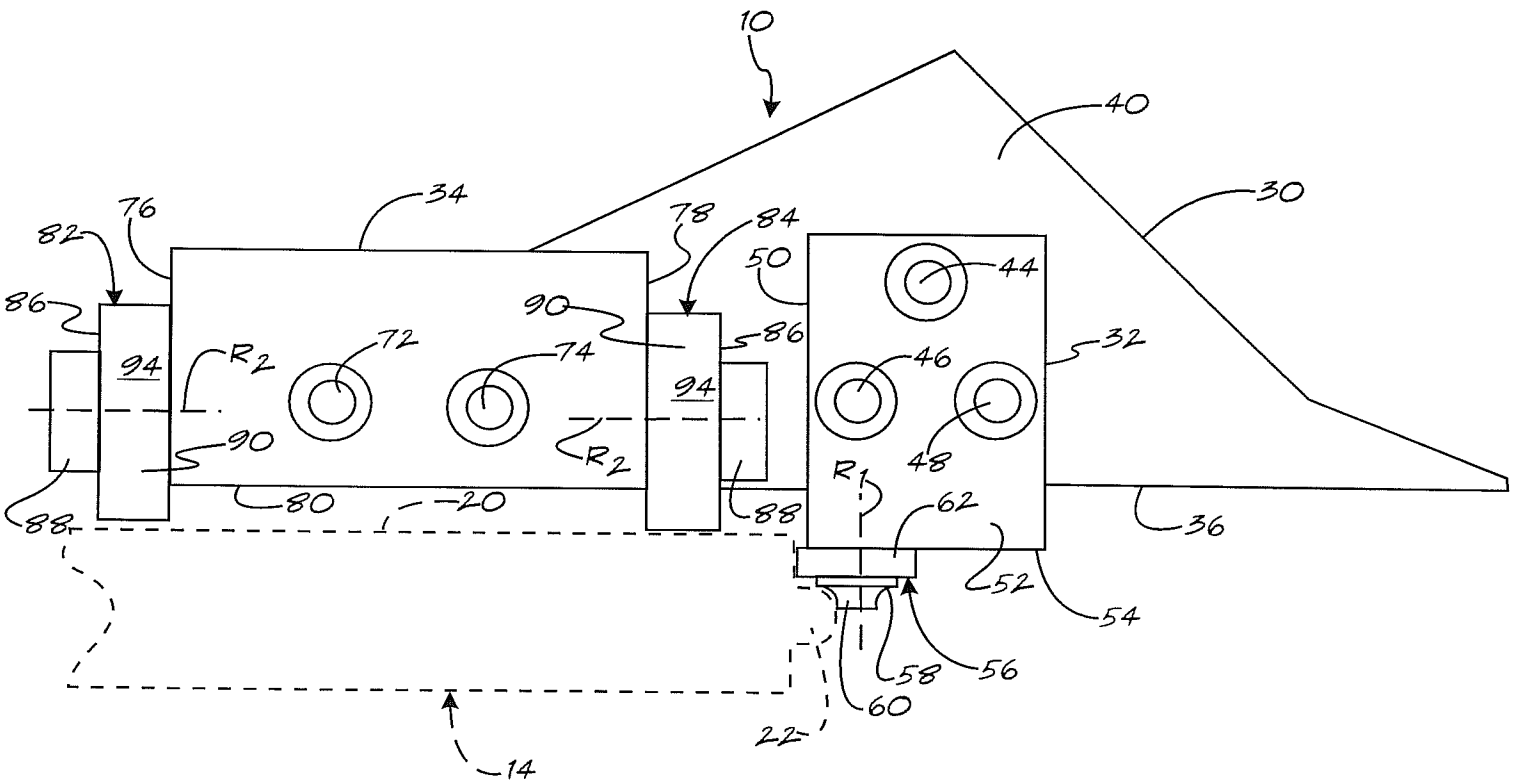
FIG. 4 is a side view of the shoe of FIG. 1.

The shoe 10 is connected to the floor stapler 12 and sits against the floor board 14 to aim the staple or nail therethrough. The shoe 10 can be a fixture permanently connected to the floor stapler 12 at the barrel portion 18, or can be an attachment removably connected to the barrel portion 18. The shoe 10 can have different designs and constructions depending on, among other things, the design and construction of the floor stapler 12 and the type and/or shape of the floor board 14. Referring to FIGS. 1, 2, and 4, in one exemplary embodiment, the shoe 10 includes a shoe body 30, a pair of guide blocks 32, and a pair of side blocks 34.

The shoe body 30 receives the floor stapler 12 and aims the barrel portion 18 appropriately to direct the staple or nail through the floor board 14. The shoe body 30 may have a one-piece structure, and may be made of a metal such as aluminum or steel and can be made of other suitable materials. The shoe body 30 has a lower wall 36 that confronts the underlying floor board 14 and subfloor 16 through a space, and that defines an opening 38 through which a staple or nail can be ejected. The shoe body 30 also has a first and second side wall 40, 42 that extend perpendicularly from the lower wall 36. In other embodiments, the shoe body 30 can have more, less, and/or different components or may be configured differently from those shown and described. The shoe body 30 can be appropriately constructed to accommodate the floor stapler 12; for example, the lower wall 36 can have an angled portion slanted up from the floor board and extending longitudinally between the first and second side walls 40, 42, the lower wall can have more than one openings 38, and the first and second side walls can have projections or other structures to support and/or locate the floor stapler.

The pair of guide blocks 32 include a first and second individual guide block that are shown substantially identical, though need not be. The guide blocks 32 help position the shoe 10 with respect to the floor board 14; for example, the guide blocks 32 locate the lateral position of the shoe when they abut the edge of floor board 14. In an embodiment, each guide block 32 has a generally rectangular structure, and is made of a metal such as 6061 aluminum alloy or steel and can be made of other suitable materials. Referring to FIGS. 1, 2, and 4-6, the first and second guide blocks are located on opposite sides of the shoe body 30, and are each mounted to a respective side wall 40, 42 via a first, second, and third bolt 44, 46, 48 that are screwed through the guide block and into the side walls 40, 42. In other examples, the guide blocks 32 could be mounted via another fastening device, welding, or adhesion. Alternatively, guide blocks 32 could be integrally formed with the side walls 40, 42. Each guide block 32 has a forward surface 50 facing the lateral direction, an outboard surface 52 facing the longitudinal direction, and a bottom surface 54 facing the subfloor 16. Each guide block 32 also has an antifriction component 56 located on the bottom surface 54.

Figure 5:
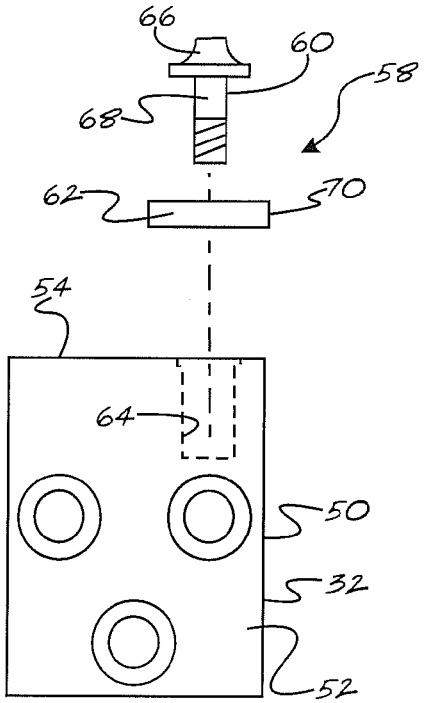
FIG. 5 is a front view of an exemplary embodiment of a guide block.
Figure 6:
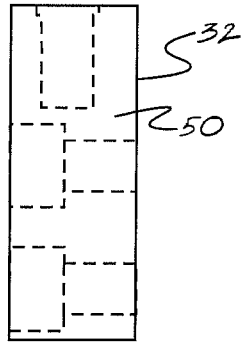
FIG. 6 is a side view of the guide block of FIG. 5.
Figure 7:
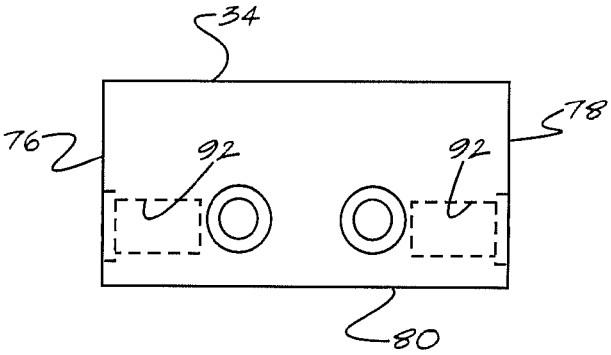
FIG. 7 is a front view of an exemplary embodiment of a side block.
Figure 8:
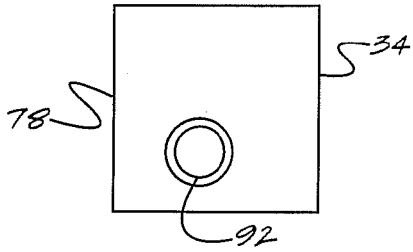
FIG. 8 is a side view of the side block of FIG. 7.

The antifriction component 56 extends from the shoe body 30 and is carried by the guide block 32. The antifriction component 56 contacts the flat face 26 of the tongue 22 to allow longitudinal sliding of the shoe 10 against the floor board 14 with reduced friction and resistance. Referring to FIGS. 4 and 5, the antifriction component 56 is a bearing such as a roller bearing 58 having a shoulder bolt 60 and a roller 62. The shoulder bolt 60 is received in a bore 64 defined in the guide block 32. The shoulder bolt 60 has a head 66 with a chamfered or otherwise radiused periphery so as not to interfere with the tongue 22 when in use, and has a shank 68 with a threaded section and an unthreaded section about which the roller 62 rotates. The roller 62 has inner and outer races carrying multiple cylinders circumferentially spaced between the inner race and outer race of the roller. An outer bearing surface 70 contacts the flat face 26 as the roller bearing 58 rotates about an axis of rotation $R_1$ which is directed at a right angle with respect to the lateral and longitudinal directions. In other examples, the antifriction component 56 could be located on the forward surface 50, the antifriction component could be another bearing type such as a ball bearing or a pad composed of an antifriction material like Teflon®, a single or more than two antifriction components could be provided, or a combination thereof.

The guide blocks 32 could have any suitable dimensions, and in other embodiments the guide blocks could be unitary with the shoe body 30 or need not be provided at all. When guide blocks 32 are not provided, the antifriction component 56 could extend directly from the shoe body 30.

The pair of side blocks 34 may include a first and second individual side block that are shown substantially identical, though need not be. The side blocks 34 help position the shoe 10 with respect to the floor board 14; for example, the side blocks locate the up-and-down vertical position of the shoe relative to the upper surface 20 of the floor board 14. Each side block 34 has a generally rectangular structure, and is made of a metal such as 6061 aluminum alloy or steel and can be made of another suitable material. Referring to FIGS. 1, 2, 4, 7, and 8, the first and second side blocks are located on opposite sides of the shoe body 30, and are each mounted to a respective side wall 40, 42 via a first and second bolt 72, 74 that are screwed through the side block and into the side wall. In other examples, the side blocks 34 could be mounted via another fastening device, welding, or adhesion. Alternatively, each side block 34 may be integrally formed with respective side walls 40, 42. Each side block 34 has a forward surface 76, a rearward surface 78, and a bottom surface 80. Each side block 34 also has a first and second antifriction component 82, 84 located on the respective forward and rearward surfaces 78, 80.

The first and second antifriction components 82, 84 extend from the shoe body 30 and are carried by the side block 34. The antifriction components 82, 84 contact the upper surface 20 of the floor board 14 to allow longitudinal sliding of the shoe 10 against the floor board with reduced friction and resistance. Referring to FIG. 4, each antifriction component 82, 84 is a bearing such as a roller bearing 86 having a shoulder bolt 88 and a roller 90. The shoulder bolt 88 (FIG. 7) is received in a bore 92 defined in the side block 34. A pair of second bores (not shown) may also be defined in the side block 34 on the opposite side of the respective forward and rearward surfaces 76, 78. The second bores could then receive the shoulder bolts 88 at a different vertical height than the bores 92 so that the first and second antifriction components 82, 84 could be adjusted vertically with respect to the lower wall 36 in order to accommodate different vertical dimensions of the flat face 26. Similar to the shoulder bolt 60 of the roller bearing 58, the shoulder bolt 88 has a head and a shank with a threaded section and an unthreaded section about which the roller 90 rotates. The roller 90 has inner and outer races carrying multiple cylinders circumferentially spaced between the inner race and the outer race of the roller. An outer bearing surface 94 contacts the upper surface 20 as the roller bearing 86 rotates about an axis of rotation $R_2$ which is directed at a right angle with respect to the longitudinal direction and is directed parallel with respect to the lateral direction. In other examples, the antifriction components 82, 84 could be located on the bottom surface 80, the antifriction components could be another bearing type such as a ball bearing or a pad composed of an antifriction material like Teflon®, any number of antifriction components could be provided, or a combination thereof.

The side blocks 34 could have any suitable dimensions, and in other embodiments the side blocks could be unitary with the shoe body 30 or need not be provided at all. When side blocks 34 are not provided, the antifriction components 82, 84 could extend directly from the shoe body 30.

In different embodiments, the different antifriction components can be of different types. For example, in one embodiment the antifriction components of the guide blocks can be bearings, while the antifriction components of the side blocks can be Teflon® pads. Furthermore, in other embodiments, the guide blocks and the side blocks could be one-piece such that the shoe would have a first block on one side carrying one or more antifriction components and would have a second separate and distinct block on its other side carrying one or more additional antifriction components.

In use, the shoe 10 slides longitudinally along the floor board 14 between neighboring stapling or nailing locations with reduced friction and resistance. The shoe 10 is supported on the floor board 14 by components 82, 84. The antifriction component 56 contacts the flat face 26 of the tongue 22 while the first and second antifriction components 82, 84 contact the upper surface 20 of the floor board. When in use, the shoe body 30 and the lower wall 36 do not directly contact the floor board 14 or the subfloor 16. When moving the shoe 10 from location to location, the rollers 62, 90 ride against their respective surfaces and the outer bearing surfaces 70, 94 remain in direct contact with the surfaces. The rollers 62, 90 rotate about their axes of rotation $R_1$, $R_2$ as the shoe 10 moves between locations. A staple or nail can be driven at any desired location and the show 10 moved to the next location.

The foregoing description is considered illustrative only of the principles of the invention. The terminology that is used is intended to be in the nature of words of description rather than of limitation. Furthermore, because numerous modifications and changes will readily occur to those skilled in the art, it is not desired to limit the invention to the exact construction and process shown as described above. Accordingly, all suitable modifications and equivalents that may be resorted to fall within the scope of the invention as defined by the claims that follow.

What is claimed is:

1. A floor stapler shoe, comprising:

a shoe body including a lower wall adapted to confront a floor board and an opening through which a staple can be ejected and having at least one side wall extending perpendicularly from the lower wall and constructed to connect to a floor stapler;

at least one guide block directly secured to the side wall of the shoe body, the guide block having a first antifriction component extending from the guide block and positioned to engage the outer surface of the floor board; and at least one side block directly secured to the side wall of the shoe body, the side block having a second antifriction component extending from the side block and positioned to engage an upper surface of the floor board, wherein the first and second antifriction components facilitate longitudinal sliding of the floor stapler shoe along the floor board between successive stapling locations and stapling actions performed by the floor stapler while the first and second antifriction components maintain contact with the floor board.

2. The floor stapler shoe of claim 1, wherein the lower wall of the shoe body includes a first side wall and a second side wall extending generally perpendicularly from the lower wall and spaced from the first side wall.

3. The floor stapler shoe of claim 1, wherein the at least a first antifriction component is a bearing, and the at least a second antifriction component is a bearing.

4. The floor stapler shoe of claim 3, wherein the bearing of the at least a first antifriction component is a roller bearing including a shoulder bolt and a roller rotating about the shoulder bolt, the bearing of the at least a second antifriction component is a roller bearing including a shoulder bolt and a roller rotating about the shoulder bolt.

5. The floor stapler shoe of claim 2, further comprising a first guide block and a second guide block, the first guide block secured to the first side wall of the shoe body and the second guide block secured to the second side wall of the shoe body, and wherein an antifriction component extends from each of the first guide block and the second guide block.

6. The floor stapler shoe of claim 5, wherein the first antifriction component is a first roller bearing including a first shoulder bolt and a first roller rotating about the first shoulder bolt, and the second antifriction component is a second roller bearing including a second shoulder bolt and a second roller rotating about the second shoulder bolt.

7. The floor stapler shoe of claim 2, further comprising a first side block and a second side block, the first side secured to the first side wall of the shoe body and the second side block secured to the second side wall of the shoe body, and wherein an antifriction component extends from each of the first side block and the second side block.

8. A floor stapler shoe, comprising:

a shoe body constructed to receive a floor stapler, the shoe body having a lower wall that confronts a floor board having an opening through which a staple can be ejected, a first side wall extending perpendicularly from the lower wall and a second side wall extending generally perpendicularly from the lower wall and spaced from the first side wall;

a first guide block directly secured to the first side wall and having an antifriction component extending therefrom, the antifriction component for contacting a surface of the floor board;

a second guide block directly secured to the second side wall and having an antifriction component extending therefrom, the antifriction component for contacting the outer surface of the floor board;

a first side block directly secured to the first side wall and having an antifriction component extending therefrom, the antifriction component for contacting an upper surface of the floor board; and a second side block directly secured to the second side wall and having an antifriction component extending therefrom, the antifriction component for contacting the upper surface of the floor board.

9. The floor stapler shoe of claim 8, wherein each of the antifriction components facilitates longitudinal sliding of the floor stapler shoe along the floor board between successive stapling locations and stapling actions performed by the floor stapler while the antifriction components maintain contact with the floor board.

10. The floor stapler shoe of claim 9, wherein the first side block has a pair of antifriction components extending therefrom for contacting the upper surface of the floor board, and the second side block has a pair of antifriction components extending therefrom for contacting the upper surface of the floor board.

11. The floor stapler shoe of claim 10, wherein each of the antifriction components each comprises a roller bearing including a shoulder bolt and a roller rotating about the shoulder bolt.

* * * * *